United States Patent [19]

Oliver

[11] 3,943,205

[45] Mar. 9, 1976

[54] INTERNAL COMBUSTION ENGINE

[75] Inventor: Wilfred T. Oliver, Rugby, England

[73] Assignee: Ford Motor Company, Dearborn, Mich.

[22] Filed: Dec. 16, 1974

[21] Appl. No.: 533,366

[30] Foreign Application Priority Data

May 3, 1974 United Kingdom ..... 19945/74

[52] U.S. Cl. ..... 261/30; 261/DIG. 78; 261/50 R; 261/69 R; 261/DIG. 67; 261/72 R; 261/78 R; 123/119 D; 123/119 E; 123/141

[51] Int. Cl.[2] ..... F02M 7/22

[58] Field of Search ..... 261/30, DIG. 51, DIG. 78, 261/50 R, 69 R, 72 R, DIG. 67, 39 D, 78 R; 123/119 D, 119 E, 141

[56] References Cited

UNITED STATES PATENTS

| | | | |
|---|---|---|---|
| 1,329,309 | 1/1920 | Prentiss | 261/DIG. 67 |
| 1,460,667 | 7/1923 | Good | 261/DIG. 51 |
| 1,901,849 | 3/1933 | Moore | 261/DIG. 51 |
| 1,969,638 | 8/1934 | Culp | 261/DIG. 78 |
| 1,984,382 | 12/1934 | Prentiss | 261/DIG. 67 |
| 2,074,471 | 3/1937 | Holley et al. | 261/39 D |
| 2,332,916 | 10/1943 | Johnson | 261/DIG. 78 |
| 2,661,195 | 12/1953 | Van Bemmel et al. | 261/30 |
| 2,828,116 | 3/1958 | Bascle, Jr. | 261/50 A |
| 3,282,573 | 11/1966 | Phelps | 261/51 |
| 3,695,591 | 10/1972 | Caisley | 261/39 D |
| 3,814,389 | 6/1974 | August | 261/DIG. 78 |

FOREIGN PATENTS OR APPLICATIONS

| | | | |
|---|---|---|---|
| 1,476,237 | 9/1969 | Germany | 261/DIG. 78 |

*Primary Examiner*—Tim R. Miles

*Attorney, Agent, or Firm*—Robert E. McCollum; Keith L. Zerschling

[57] ABSTRACT

A carburetor has a small air passage connected to the main induction passage by a sonic flow orifice; the small passage being supplied with compressed air at all times at a pressure and volume maintaining sonic flow; a fuel supply line is connected to the orifice for a constant flow of fuel, the rate of flow being varied as a function both of throttle valve position and manifold vacuum level.

12 Claims, 7 Drawing Figures

INTERNAL COMBUSTION ENGINE

This invention relates in general to internal combustion engines and in particular to a carburetor for such engines.

It is known that substantial reduction of exhaust emissions of unburned hydrocarbons, carbon monoxide and oxides of nitrogen can be achieved by running an engine on a lean air/fuel ratio of the order of 18 to 20 parts of air to 1 part of fuel. Internal combustion engines are reluctant to run smoothly at such fuel ratios. One problem is that inadequate fuel mixing and atomization causes the fuel ratio at different cylinders to be greater or less than the average fuel ratio at which the engine is operating. Clearly, if the mixing and atomization of the mixture can be improved so that a more uniform mixture is supplied to the cylinders, the average fuel ratio can be made leaner without affecting the running of the engine.

It has been found that greatly improved fuel atomization takes place in the shock waves and turbulence which accompany sonic flow of the mixture through an orifice. Unfortunately, the manifold depression of a conventional Otto cycle engine is insufficient to produce induction of an air/fuel mixture at sonic velocity through its full load range. Typical examples of carburetors of air/fuel mixing devices that utilize the principle of sonic flow for better fuel atomization are those shown and described in U.S. Pat. No. 3,778,038, Eversole et al., U.S. Pat. No. 3,282,572, Karlovitz, and U.S. Pat. No. 3,841,389, August. However, in each of these cases, sonic flow occurs over only a portion of the engine operating range and is dependent entirely on the manifold vacuum and the sizing of the flow area.

According to the invention an internal combustion engine has the following features:

a. a carburetor has a barrel or induction passage connected to an inlet or intake manifold of the engine;

b. an air pump supplies compressed air to the barrel through a pumped air passage having a sonic flow orifice;

c. the capacity of the air pump is sufficient to maintain a flow of air through the orifice at sonic velocity during all engine operating conditions;

d. the sonic flow orifice is sufficiently large to provide the flow of air required for idle operation of the engine;

e. fuel is supplied into the pumped air passage at the orifice;

f. a throttle valve controls flow of air from the atmosphere into the barrel; and, g. as the throttle valve is opened to admit more air, the supply of fuel to the pumped air passage is increased.

In the engine of the invention, all the fuel required by the engine at any operating condition including full throttle operation passes through the sonic flow orifice and is subject, therefore, to the turbulence and shock waves caused by flow at sonic velocity. The air pump ensures that the sonic flow condition is maintained by keeping the pressure in the pumped air passage higher than the maximum absolute manifold pressure by at least the critical value or ratio necessary to produce sonic flow. At idle, the throttle valve is closed and all the air and fuel required by the engine passes through the sonic flow orifice. As the throttle is opened, the quantity of fuel flowing to the sonic flow orifice is increased. The fuel supply is controlled so that for any throttle opening and engine operation condition an over rich mixture is supplied through the sonic flow orifice which when diluted by the air flowing through the throttle valve has the required air/fuel ratio.

The invention will now be described with reference to the accompanying drawings, in which.

Figure 1:
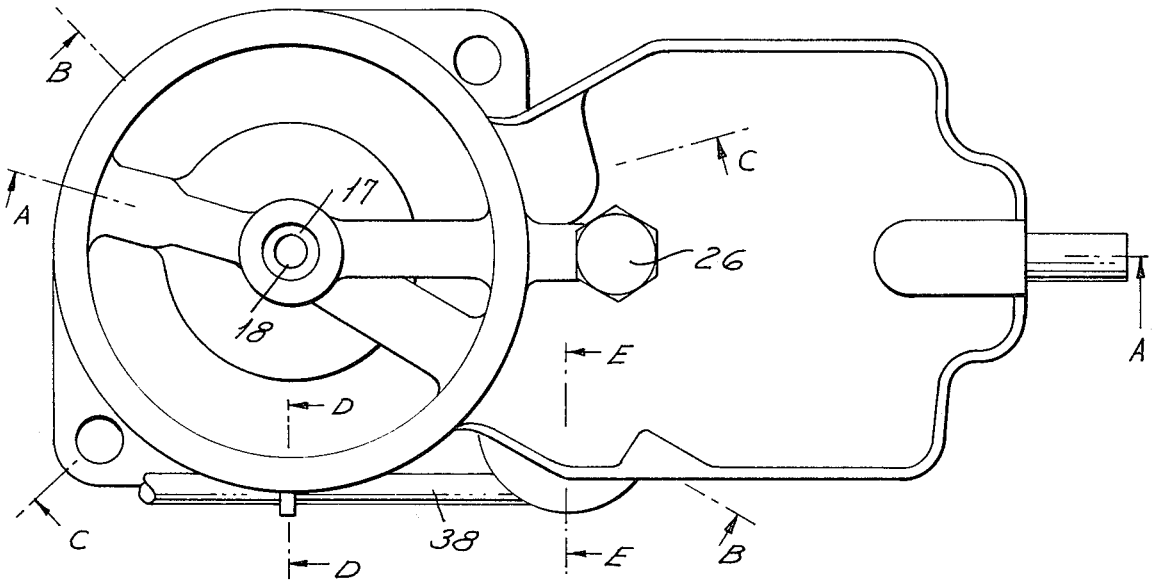
FIG. 1 is a plan view of a carburetor for an internal combustion engine embodying the invention.
Figure 2:
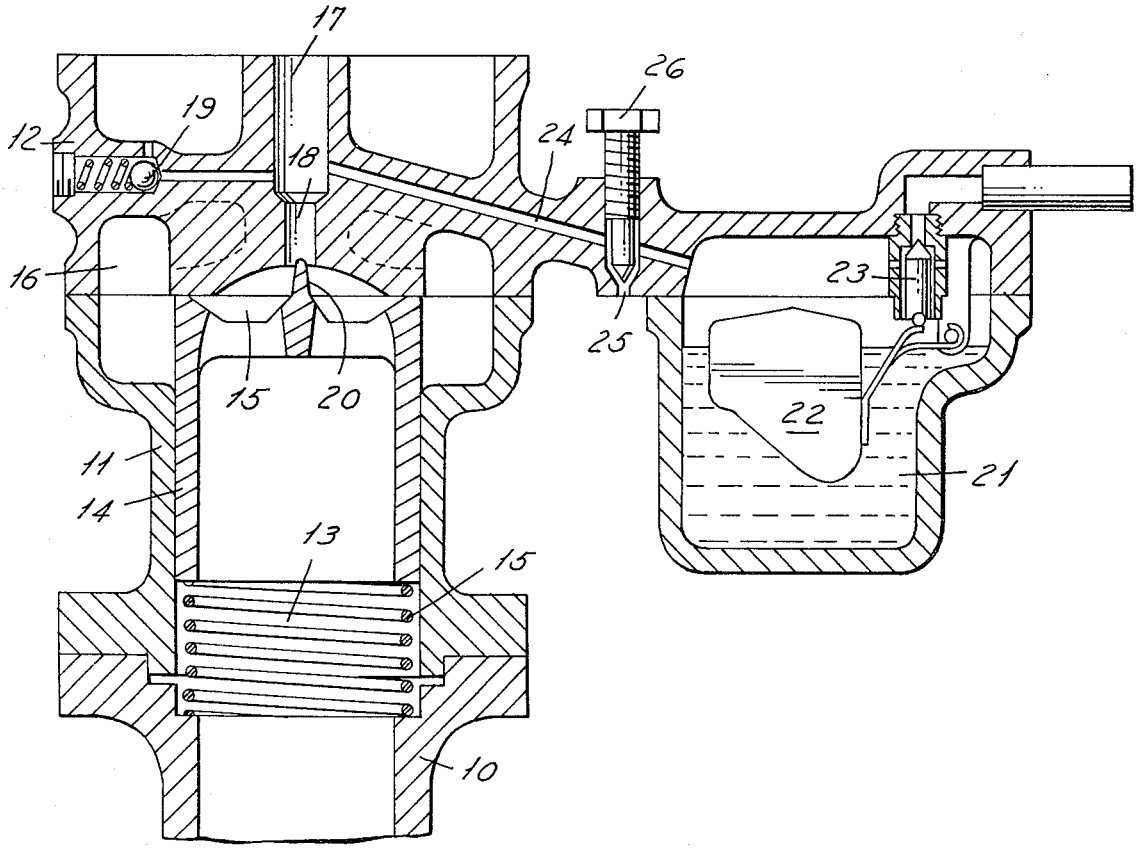
FIG. 2 is a section along the line A—A of FIG. 1.

The internal combustion engine (not shown) has an inlet or intake manifold 10 (FIG. 2) upon which is mounted a downdraft type carburetor shown in the drawings.

The carburetor has a lower cylindrical body portion 11 and an upper cylindrical body portion 12 of larger diameter. The two portions form lower and upper portions of an air/fuel induction passage 13. The lower body portion 11 communicates at its lower end with the inlet manifold 10. A hollow cylindrical throttle valve 14 is axially slidable in the induction passage 13 and is urged upwardly into contact with the upper body 12 by a coil spring 15.

The cylindrical throttle valve 14 defines with the upper body 12 an annular throttle opening 15 supplied with air at atmospheric pressure through an annular chamber 16. An air cleaner (not shown) mounted above the upper body 12 supplies clean air essentially at atmospheric or ambient pressure to the annular chamber 16.

An air passage 17 is provided in a central axially extending partition formed in the upper body portion 12. The partition terminates short of the junction with the lower body portion 11 to define a portion of the main air flow passage. The partition extends laterally at its lower end for cooperation with the upper end edge of the throttle valve 14 to block air flow past the valve.

An air pump (not shown) is connected to the inlet end of air passage 17. A sonic velocity flow restricting orifice 18 is formed by a portion of reduced cross section at the lower or discharge portion of the pumped air passage 17. The capacity of the pump is sufficient to maintain air flow at sonic velocity through the orifice 18 at all engine operating conditions and the cross-sectional area of the orifice 18 is such that it can pass sufficient air for the engine's requirements at normal idle speed.

A substantially constant pressure is maintained in the pumped air passage 17 by a conventional check valve 19 which vents the air passage 17 to the annular air chamber 16 when the pressure in the air passage 17 rises above a predetermined value.

A combination flow guide and obturator 20 is mounted on the throttle valve 14 to project into the lower end of the orifice 18 when the throttle valve is in its idle position shown.

A float chamber 21 is formed in the lower body portion 11 and is supplied with fuel through an inlet line 21a from a conventional fuel pump (not shown). The fuel level in the bowl 21 is maintained at a predetermined level by a float 22 connected to a valve 23 in the conventional manner.

The vapor space above the fuel in the fuel bowl 21 is closed to the atmosphere except for a connection to the pumped air passage 17 by a vent passage 24. An air bleed passage 25 in the vent passage 24 is controlled by an adjustable needle valve member 26 so that the pressure over the fuel in the bowl 21 can be adjusted.

Figure 3:
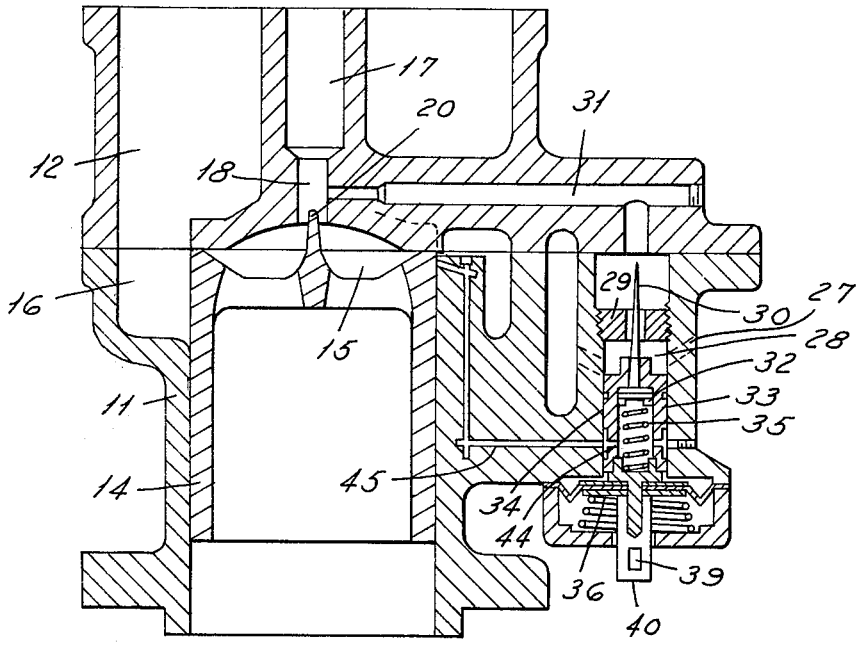
FIG. 3 is a section along the line B—B of FIG. 1.

As seen in FIG. 3, fuel from the bowl 21 passes through a passage 27 into a needle valve chamber 28, through a main fuel jet or orifice 29 controlled by a tapered needle valve 30, and along a fuel passage 31 to be inducted into the sonic flow orifice 18.

The pressure difference between the fuel bowl 21 and the sonic flow orifice 18 remains substantially constant for all engine operating conditions. The rate of fuel flow into the sonic flow orifice 18 is thus determined solely by the position of the needle valve 30.

Figure 5:
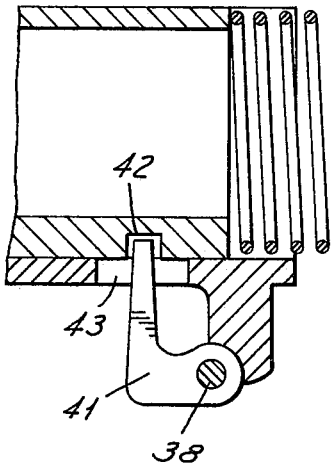
FIG. 5 is a part section along the line D—D of FIG. 1.
Figure 6:
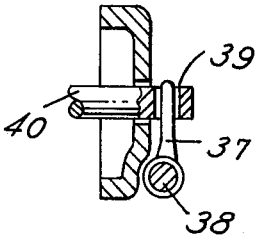
FIG. 6 is a part section along the line E—E of FIG. 1.

The needle valve 30 is fixed at its lower end to a piston 32 slidable in a cylindrical recess 33 inside a sleeve 34. The piston 32 is urged towards the upper end of the cylinder 33 by a spring 35. The lower end of the sleeve 34 is fixed to a flexible diaphragm 36 that prevents any escape of fuel from the lower end of the valve chamber 28. Referring also to FIGS. 5 and 6, the diaphragm is mechanically connected by a lever or linkage 37 to a throttle valve actuating shaft 38. The lever 37 is received within an aperture 39 of connecting member 40 fixed to the diaphragm 36. The shaft 38 also carries a throttle valve actuating lever 41 which engages a groove or recess 42 in the throttle valve 14 through a slot 43 in the wall of the lower body portion 11.

When the throttle shaft 38 is rotated to open the throttle valve from the closed idle position shown in the drawings, the diaphragm 36 is simultaneously displaced mechanically downwardly carrying with it the sleeve 34 and the needle valve 30, thereby increasing the size of the orifice provided by the main fuel jet 29.

The cylindrical recess 33 within the sleeve 34 also constitutes a part of a vacuum servo, and is connected by apertures 44 in the sleeve 34 and by a passage 45 in the main body portion 11 to the carburetor induction passage 13. The upper end of passage 45 is uncovered by the throttle valve 14 when the throttle valve is opened. Cylindrical recess 33 is then subject to manifold depression and the piston 32 and needle valve 30 are further displaced in accordance with the prevailing manifold depression. The mechanical connection between the throttle valve and needle 30 thus defines the minimum displacement of the needle corresponding to the throttle opening. The result is that the displacement of the needle and hence the additional fuel passed by the main fuel jet is dependent both upon the size of the throttle opening and upon the pressure difference across the throttle opening and so can be made proportional to the air flow through the throttle opening for all engine operating conditions.

Figure 4:
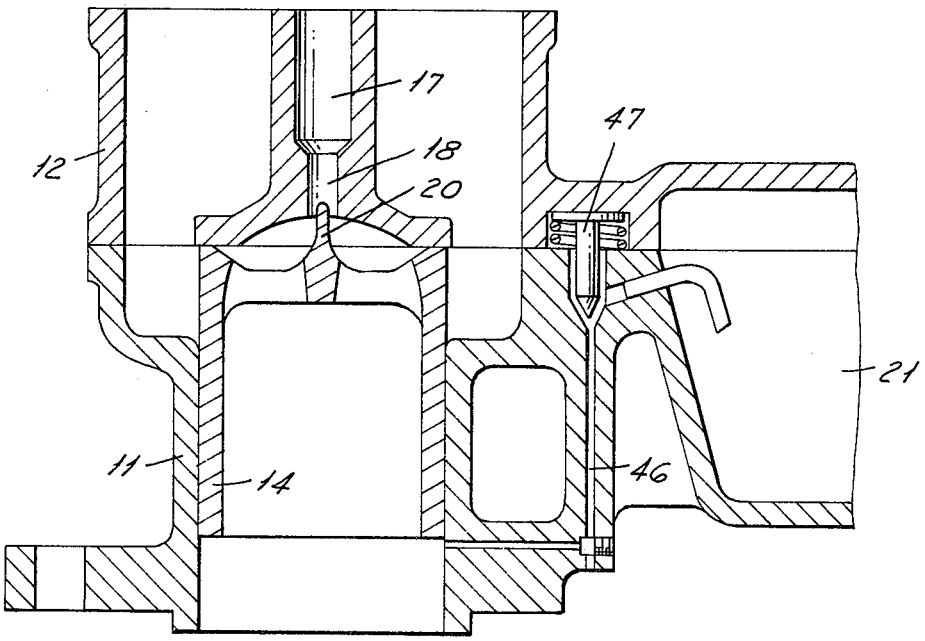
FIG. 4 is a section along the line C—C of FIG. 1.

Referring now to FIG. 4, a cold start fuel enrichment device comprises a spring loaded valve in a passage 46 connecting the fuel bowl to the induction passage 13 downstream of the throttle valve 14 in its idle position. Additional fuel is drawn through this passage when the engine is turned over by a starter motor. When the engine fires and accelerates up to idle speed, the pressure in the manifold falls and closes valve 47, which is set to close at a predetermined pressure less than the manifold pressure at idle speed. When the throttle valve is opened, the manifold pressure will fall below that required to keep the valve 47 closed, but under such conditions the throttle valve will have moved down and closed the discharge end of the cold start fuel passage 46.

In operation, so long as the engine is running, there is always flow at sonic velocity through the sonic flow orifice 18. At idle (the condition illustrated in the drawings) all the air supplied to the engine is passing through the sonic flow orifice 18, and the needle valve 30 is in the appropriate position to provide the rate of flow to provide the quantity of fuel required for idle. The idle air fuel mixture passes through the turbulence and shock waves produced by the sonic flow through the orifice 18.

As the throttle valve is opened, additional air flows through the annular throttle opening 15. The needle valve 30 is displaced in accordance with both throttle position and manifold depression to increase the fuel supply to the orifice 18. The increase in fuel supply is that required to form the desired air/fuel ratio with the additional air passing through the throttle opening 15. Thus an over-rich mixture passes through the sonic flow orifice 18 and is subjected to mixing and atomization by the shock waves and turbulence created by flow at sonic velocity. This over-rich mixture is diluted by the main supply of air flow through the throttle valve from chamber 16 to form the required cloud of atomized air/fuel mixture. The obturator 20 is shaped as a guide member to promote mixing between the air/fuel mixture passing through the orifice 18 and the air flowing through the throttle opening.

The embodiment described above has a fixed size sonic flow orifice 18. The size of this orifice is selected to provide the correct idling speed at a particular engine operating temperature. At operating temperatures below this design temperature, the idling speed will be too low because of the greater engine friction and the engine may stall. At operating temperatures above this design temperature, the idling speed will be high because of the reduced engine friction.

Figure 7:
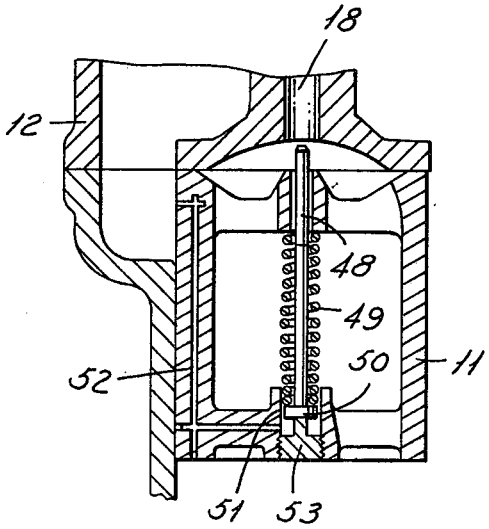
FIG. 7 is a part section similar to FIG. 2 showing a modification of the invention with provision for controlling idle speed at different engine temperatures.

FIG. 7 shows a modification of the invention having a movable obturator 48 arranged to provide a substantially constant idle speed.

In FIG. 7 the obturator is slidably mounted in the throttle valve 14 and urged downwardly by a coil spring 49. A piston 50 formed by the lower end of the obturator works in a cylindrical recess 51 formed in the throttle valve 14. The lower side of the piston 50 is connected to atmospheric or ambient pressure in the annular chamber 16 by passage 52 and the upper side of the piston 50 is exposed to manifold depression. When the engine is started at the coldest engine operating temperatures the manifold depression is insufficient to displace the obturator piston 50 from the stop 53 and the discharge outlet of the sonic flow orifice 18 is at its maximum size. As the engine temperature increases, the engine idle speed tends to increase because the friction of the engine decreases and the manifold vacuum increases. This displaces the obturator 48 upwardly to reduce the size of orifice 18 and thereby reduce the quantity of air/fuel mixture provided to the engine, thereby keeping the idle speed down to the required value.

While the invention has been described and shown in its preferred embodiments, it will be clear to those skilled in the arts to which it pertains that many changes and modifications may be made thereto without departing from the scope of the invention.

I claim:

1. A carburetor having an air/fuel induction passage open to air at one end and connected at its opposite end to the intake manifold of an internal combustion engine to be subject to the manifold vacuum therein for the flow of an air/fuel mixture thereinto, a throttle valve in the passage movable between positions opening and closing the passage, an additional air passage having a discharge portion open to the induction passage on the manifold side of the throttle valve and connected at its inlet end to a compressed air source of a capacity providing a pressure in the air passage higher than the maximum manifold pressure by a critical value sufficient to maintain air flow through the air passage at sonic velocity at all times during engine operation, and a fuel supply line connected to the air passage for the induction of a continuous supply of fuel therefrom into the air passage irrespective of the position of the throttle valve, the air passage comprising a flow restricting orifice, the throttle valve having additional means thereon movable into and out of the discharge end of the air passage upon predetermined movement of the throttle valve to vary the orifice size and flow volume as a function of throttle valve movement.

2. A carburetor as in claim 1, the additional means comprising a combination flow deflector and obturator promoting mixing of the air/fuel mixture flowing through the air passage with the additional air flowing through the induction passage upon opening of the throttle valve.

3. A carburetor as in claim 1, the additional means comprising an obturator movably mounted with respect to the throttle valve and movable by the differential between manifold vacuum and atmospheric pressure acting thereon to vary the position of the obturator with respect to the air passage discharge when the throttle valve is in a closed position to thereby vary the flow volume through the air passage.

4. A carburetor having a cylindrical air/fuel induction passage open to air at one end and connected at its opposite end to the intake manifold of an internal combustion engine to be subject to the change in manifold vacuum therein for the flow of an air/fuel mixture thereinto, the passage being defined by lower and upper cylindrical portions, the upper portion being of larger diameter, the lower portion containing a hollow cylindrical axially slidable throttle valve open at its ends, the upper cylindrical portion having a central axially extending partition therein terminating short of the junction between the cylindrical portions to define a path for the flow of air between the portions, the throttle valve being axially movable between a closed passage position wherein the throttle valve edge abuts the partition to block air flow between portions and open passage positions permitting the air flow, the partition containing an additional air passage connected at one end to a compressed air source and at its other end at all times to the induction passage and manifold through the open ends of the throttle valve, the additional air passage containing a flow restricting orifice, the compressed air source being of a capacity providing a pressure in the air passage higher than the maximum manifold pressure by a critical value sufficient to maintain air flow through the orifice at sonic velocity at all times, and a fuel supply line connected to the orifice for the induction of a continuous supply of fuel into the orifice and out into the induction passage regardless of the position of the throttle valve.

5. A carburetor as in claim 4, wherein the fuel line includes movable means to vary the rate of fuel flow.

6. A carburetor as in claim 4, wherein the fuel supplied to the air passage provides a richer than stiochiometric air/fuel mixture in the air passage at all times during engine operation.

7. A carburetor as in claim 4, including air/fuel mixture guide means on the throttle valve end projecting towards the orifice for mixing the mixture with air passing between induction passage portions upon opening of the throttle valve.

8. A carburetor as in claim 7, including means mounting the obturator for movement relative to the throttle valve to permit variance of the output of air through the air passage when the throttle valve is in a closed position.

9. A carburetor as in claim 8, the latter means including piston means connected to the obturator and subject to a force differential between the pressure of air in the upper portion of the induction passage acting thereon and manifold pressure acting thereon.

10. A carburetor as in claim 4, the fuel supply line including a fuel orifice and needle valve combination, and force means responsive to throttle valve movements for moving the needle valve to vary fuel flow rate to the air passage orifice.

11. A carburetor as in claim 10, wherein the force means includes a linkage connection to the throttle valve.

12. A carburetor as in claim 11, wherein the force means includes a vacuum servo having force means connected to the needle valve and a vacuum connection to the induction passage operable when the throttle valve is moved to an open position.

* * * * *